US011233326B2

(12) United States Patent
Keller et al.

(10) Patent No.: US 11,233,326 B2
(45) Date of Patent: Jan. 25, 2022

(54) OPTICAL FEED NETWORK USING A FREE-SPACE OPTICAL MODULATOR FOR RF PHASED ANTENNA ARRAYS

(71) Applicant: Raytheon Company, Waltham, MA (US)

(72) Inventors: Sean D. Keller, Tucson, AZ (US); Gerald P. Uyeno, Tucson, AZ (US); David G. Manzi, Tucson, AZ (US); Benn Gleason, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 69 days.

(21) Appl. No.: 16/837,654

(22) Filed: Apr. 1, 2020

(65) Prior Publication Data

US 2021/0313685 A1 Oct. 7, 2021

(51) Int. Cl.
*H01Q 3/26* (2006.01)
*H01Q 3/46* (2006.01)

(52) U.S. Cl.
CPC ..... *H01Q 3/2676* (2013.01); *H01Q 3/46* (2013.01)

(58) Field of Classification Search
CPC ..... H01Q 3/2676; H01Q 3/46
See application file for complete search history.

(56) References Cited

U.S. PATENT DOCUMENTS

| | | | | |
|---|---|---|---|---|
| 4,965,603 | A | 10/1990 | Hong et al. | |
| 5,311,196 | A * | 5/1994 | Hanson | H01Q 3/2676 342/368 |
| 5,333,000 | A | 7/1994 | Hietala et al. | |
| 9,614,280 | B2 | 4/2017 | Shi et al. | |
| 2006/0056847 | A1 | 3/2006 | Akiyama et al. | |
| 2019/0319356 | A1 | 10/2019 | Shi et al. | |

OTHER PUBLICATIONS

"International Application Serial No. PCT/US2020/065575, International Search Report dated Apr. 7, 2021", 3 pgs.
"International Application Serial No. PCT/US2020/065575, Written Opinion dated Apr. 7, 2021", 11 pgs.
Stulemeijer et al., "Photonic Integrated Beamformer for a Phased Array Antenna," ECOC '98, Sep. 20-24, 1998, Madrid Spain, pp. 637-638.
Schuetz et al., "A Promising Outlook for Imaging Radar," IEEE Microwave Magazine, May 2018, pp. 91-101.

* cited by examiner

*Primary Examiner* — Awat M Salih
(74) *Attorney, Agent, or Firm* — Schwegman Lundberg & Woessner, P.A.

(57) ABSTRACT

An optical feed network (OFN) for an RF phased antenna array includes a single free-space optical beamformer that supports all of the RF electrical feed signals for the RF phased antenna array to steer an RF beam. The free-space optical beamformer can more easily scale to accommodate larger array sizes than either the discrete fiber channel or PIC implementations. Furthermore, certain embodiments of the optical beamformer avoid the complexity of having to compute FFTs for each channel to steer the beam, instead relying on the inherent function of an imaging lens to perform the FFT, which in turn facilitates rapid steering.

20 Claims, 9 Drawing Sheets

OPTICAL FEED NETWORK USING A FREE-SPACE OPTICAL MODULATOR FOR RF PHASED ANTENNA ARRAYS

BACKGROUND OF THE INVENTION

Field of the Invention

This invention relates to RF phased antenna arrays and more particularly to an optical feed network that uses a free-space optical modulator for phased RF antenna arrays.

Description of the Related Art

RF transmitters are used to broadcast signals for such applications as radio and televisions, establish bi-directional communications such as between cell phones and as part of radar systems. The RF (microwave) spectrum extends to 300 GHz with 0-30 GHz representing conventional RF applications and 30-300 GHz referred to as millimeter wave (MMW). The RF transmitter generates an electrical feed signal a desired RF reference frequency that drives an RF antenna to broadcast the RF beam.

One type of RF transmitter is known as a "phased antenna array", a computer-controlled array of antennas that creates a beam of RF waves that can be electronically steered to point in different directions without moving the antennas. In a phased antenna array, the RF electrical feed signal is fed to the individual antennas with the correct phase relationship so that the RF waves from the separate antenna add together to increase the radiation in a desired direction, while cancelling to suppress radiation in undesired directions. The power from the transmitter is fed to the antennas through devices called phase shifters, controlled by the computer system, which can alter the phase electronically, thus steering the beam of RF waves to a different direction. The phased array typically comprises many small antennas (sometimes thousands) to achieve high gain.

A drawback to RF phased antenna arrays is the large volume and weight of the RF-electronic beamforming network. This problem is overcome using an optical feed network to provide the RF electrical feed signals. The principle of operation uses a coherent detection scheme to directly transfer the phase and amplitude of an optical signal to a microwave signal by mixing this signal with an optical local oscillator (LO) signal. If the optical frequency of the LO signal differs by 10 GHz from the input signal than a 10 GHz microwave signal with the same phase as the optical signal will be obtained after combination and detection of the two signals. In this way, modulation of phase and amplitude of a microwave signal can be performed using optical phase and amplitude modulators, which are much smaller than their counterpart RF devices. See "Photonic Integrated Beamformer for a Phased Array Antenna" J. Stulemeijer, et. al. ECOC '98, 20-24 Sep. 1998 Madrid, Spain and "Radiofrequency signal-generation system with over seven octaves of continuous tuning" Garret J Schneider, et. al. Nature Photonics, 20 Jan. 2013.

As shown in FIG. 1, a typical optical feed network (OFN) 10 feeds first and second optical signals 12 and 14 at frequencies ω1 and ω2 having a frequency difference directly proportional to a desired RF reference frequency into respective 1-to-N optical waveguide splitters 16 and 18, which split the signals into optical channel signals. N electro-optic phase modulators 20, responsive to computer-controlled steering commands from a controller 21, phase modulate the ω1 optical channel signals. N 2-to-1 optical combiners 22 combine the phase-shifted ω1 optical channel signals and ω2 optical channel signals, respectively, to form combined optical channel signals, which are optically coupled to N photo-detectors 24 that detect the respective combined optical channel signals and generate a plurality of RF electrical feed signals 26 that drive RF antennas 28 to produce a steerable RF beam 30 at the desired RF reference frequency. The optical feed network sans the photo-detectors can be implemented in discrete fiber channels. Alternately, the entire optical feed network can be integrated onto a single chip, referred to as a "photonic integrated circuit (PIC)".

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides an optical feed network (OFN) for an RF phased antenna array in which a single free-space optical beamformer supports all of the RF electrical feed signals for the RF phased antenna array to steer an RF beam. The free-space optical beamformer can more easily scale to accommodate larger array sizes than either the discrete fiber channel or PIC implementations. Furthermore, certain embodiments of the optical beamformer avoid the complexity of having to compute FFTs for each channel to steer the beam, instead relying on the inherent function of an imaging lens to perform the FFT, which in turn facilitates rapid steering.

In an embodiment, the OFN receives first and second optical signals at frequencies ω1 and ω2 having a frequency difference equal to a desired RF frequency. A collimating lens collimates the first optical signal to fill an aperture of a free-space optical beamformer. The optical beamformer is responsive to beam steering commands to process the collimated first optical signal and generate a free-space optical beam at a specified optical steering angle. A plurality of lenses are configured to sample a wavefront of the optical beam over a range of optical steering angles. A subset of the lenses sample the wavefront at the specified optical steering angle to generate and focus a plurality of optical channel signals to preserve a relative phase between the optical channel signals and the wavefront. A plurality of photo-detectors are configured to detect the plurality of optical channel signals at frequency ω1 over the range of optical steering angles and the second optical signal at frequency ω2. A subset of the photo-detectors receive the optical channel signals for the specified optical steering angle to generate a plurality of RF electrical feed signals at the desired RF frequency that preserve the relative phase to produce an RF beam at an RF steering angle. The arrays of lenses and photo-detectors must be "oversized" with respect to the size of the optical beam to accommodate the range of optical steering angles. At a given steering angle, the unused photo-detectors are suitably turned off to prevent dark current emissions, if any.

In an embodiment, the free-space optical beam former comprises an optical beam steerer that is responsive to the beam steering commands to act on and induce different phase delays to different regions of the collimated first optical signal that combine to produce the free-space optical beam at the specified optical steering angle. In the general case, the beam steerer produces a phase delay including a linear term across the wavefront to determine the steering angle. The beam steerer may also produce a phase delay including linear and spherical or aspherical terms to control the optical beam through such methods as focusing power and wavefront correction.

The optical beam steerer may be, for example, implemented with a Risley prism or a liquid crystal (transmission or reflection mode) or MEMs spatial light modulator. The optical beam steerer is configured to vary the relative effective path lengths of the optical signals to steer the optical beam. This may be accomplished either by directly varying the path lengths, varying the path lengths signals propagate through a constant refractive index or by varying the refractive indices to act on the individual optical signals to induce the phase delays.

In another embodiment, the free-space optical beam former comprises lenses that sample the wavefront of the first optical signal to focus the light into multiple spots at different positions on a spatial light modulator (SLM). The SLM selectively re-directs one more spots whose position on the SLM corresponds to a specified steering angle to an imaging lens to produce the free-space optical beam. Activation of a single SLM "pixel" and transmission of the first optical signal from a single spot will produce an optical beam whose wavefront exhibits a linear phase delay. Activation of multiple pixels and spots, either simultaneously or in a time sequence, may produce a non-linear phase delay across the wavefront to shape the optical beam. The SLM may, for example, be implemented with a Digital Micro Mirror (DMD) whose pixels switch between binary on/off states or electro-absorptive modulators.

In different embodiments, the optical signals occupy a portion of the optical spectrum between in the near Infrared (NIR) band between 0.7 and 3.0 microns (~100 to ~430 THz). The OFN feeds an RF phased antenna array that is configured to transmit in a portion of the RF band between 0-300 GHz or a portion of the mmW band between 30-300 GHz. In different embodiments, the same design of the OFN can be used for different RF phased antenna arrays spanning the RF spectrum from 0-300 GHz.

These and other features and advantages of the invention will be apparent to those skilled in the art from the following detailed description of preferred embodiments, taken together with the accompanying drawings, in which:

DETAILED DESCRIPTION OF THE INVENTION

The present invention provides an optical feed network (OFN) for an RF phased antenna array in which a single free-space optical beamformer support all of the RF electrical feed signals for the RF phased antenna array to steer an RF beam. The free-space optical beamformer can more easily scale to accommodate larger array sizes than either the discrete fiber channel or PIC implementations. Furthermore, certain embodiments of the optical beamformer avoid the complexity of having to compute FFTs for each channel to steer the beam, instead relying on the inherent function of an imaging lens to perform the FFT, which in turn facilitates rapid steering.

Figure 1:
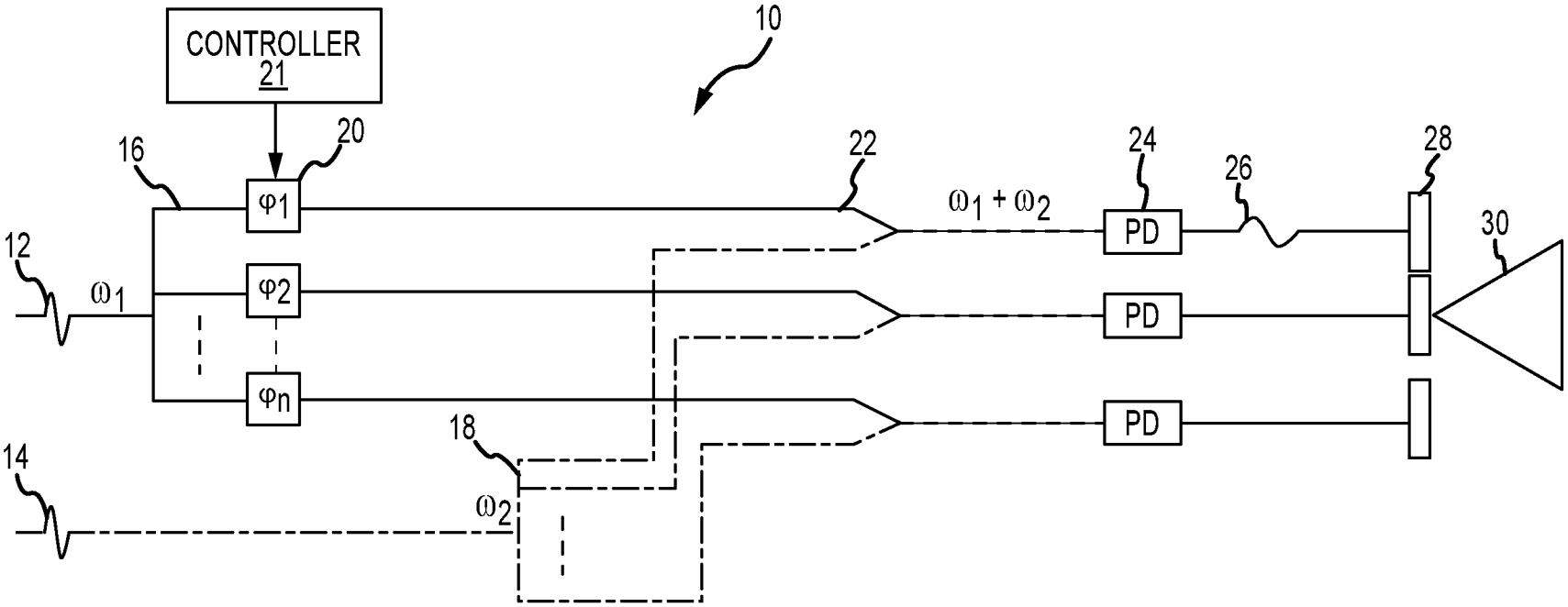
(PRIOR ART) FIG. 1
FIG. 1, as described above, is a diagram of an optical feed network for an RF phased array.
Figure 2:
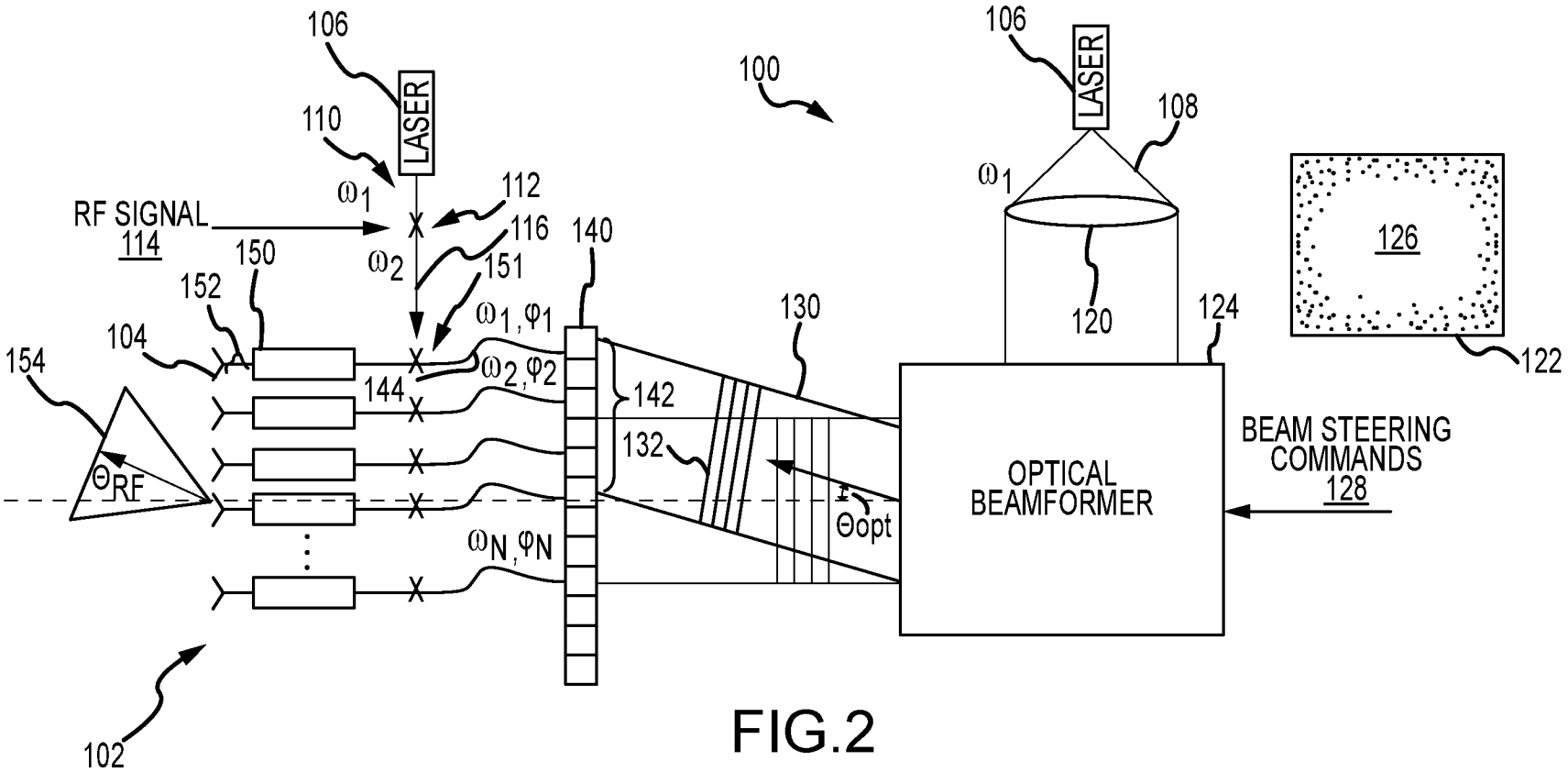
FIG. 2 is a diagram of an embodiment of an optical feed network using a free-space optical beamformer.
Figure 3:
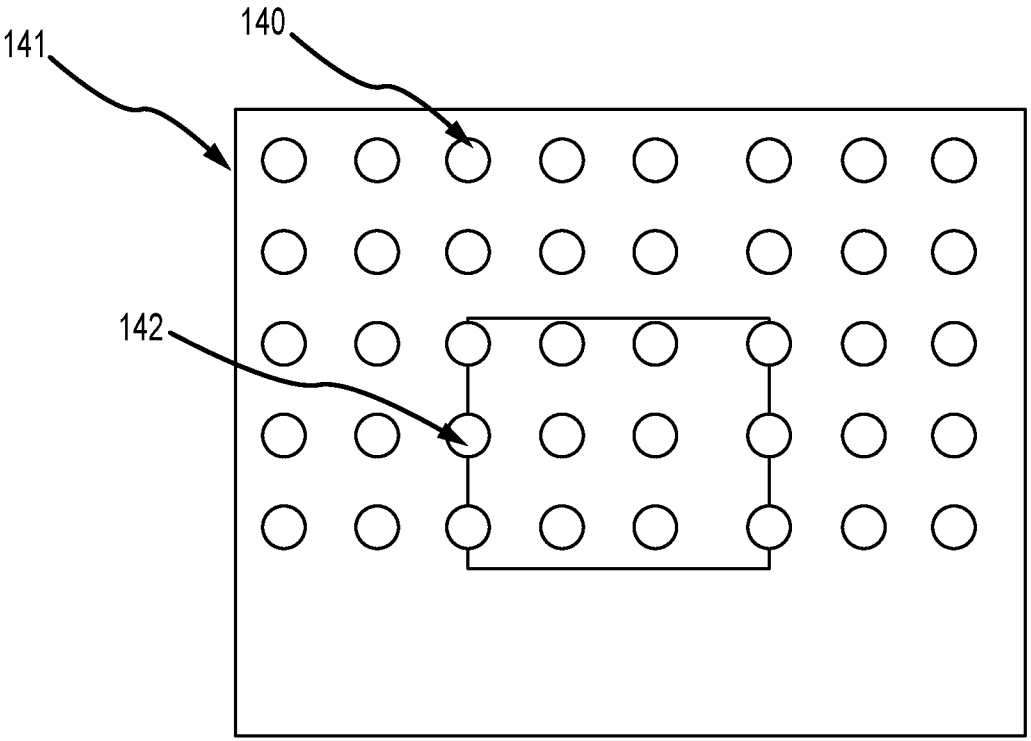
FIG. 3 is a diagram illustrating the oversized lens array to sample the wavefront of the free-space optical beam over a range of optical steering angles.

Referring now to FIGS. 2 and 3, an embodiment of an OFN 100 for an RF phased antenna array 102 including a plurality (e.g. N×N array) of antenna elements 104 arranged in a first pattern. The OFN 100 may include one or more lasers 106 that generate first optical signal 108 and 110 at frequency ω1. For example, a laser that emits at 1550 nm provides the requisite linewidth and coherence to achieve the RF down conversion. Other optical wavelengths, typically in the Near IR, may be used. A modulator 112 modulates optical signal 110 with an RF signal 114 to produce a second optical signal 116 at frequency ω2 such that the first and second optical signals 108 and 116 have a frequency difference equal to the RF frequency. Various configurations to generate these optical signals either as part of the OFN or outside the OFN may be used.

A collimating lens 120 collimates the first optical signal 108 to fill an aperture 122 of an optical beamformer 124 with the collimated first optical signal 126. Optical beamformer 124 is responsive to beam steering commands 128 to process the collimated first optical signal and generate a free-space optical beam 130 at a specified optical steering angle θopt. A phase delay across a wavefront 132 of free-space optical beam 130 determines the steering angle θopt. A linear phase delay includes only a linear phase term. A non-linear phase delay includes a linear term as well as spherical or aspheric terms to control the optical beam through such methods as focusing power and wavefront correction.

A plurality of lenses 140 (e.g. N×N array 141) are arranged in a second pattern corresponding to the first pattern of the RF antenna elements. The patterns "correspond" when the physical arrangement of the lenses 140 is the same as the physical arrangement of the antenna elements 104. The spacing of the lenses and antenna elements is different due to the different wavelengths.

Lenses 140 are configured to sample wavefront 132 of the optical beam 130 over a range of optical steering angles. A subset 142 (e.g. M×M array where M<N) of lenses 140 sample the wavefront at the specified optical steering angle to generate and focus a plurality of optical channel signals 144 at frequency ω1 and phases φ1 . . . φN to preserve a relative phase between the optical channel signals 144 and the wavefront 132. In other words, the optical beam forms a spot on the subset of lenses. The position of the spot relative to the entire array of lenses contains the phase information that then determines the RF steering angle. In order to sample the wavefront 132 over the range of optical steering angles and avoid vignetting, the full N×N array of lenses 140 must be oversized with respect to the subset 142 need to sample the wavefront at a given steering angle. The larger the steering range, the greater the full array of lenses must be oversized. The plurality of lenses 140 may be implemented in microlens bulk optic to achieve the requisite spacing.

A plurality of photo-detectors 150 (e.g. N×N array) are configured to detect the plurality of optical channel signals 144 at frequency ω1 over the range of optical steering angles and the second optical signal 116 at frequency ω2. The two optical signals are combined via, for example, a waveguide combiner 151 or in free-space and "beat" at the photodetector causing it to output an electrical feed signal 152 at the desired RF frequency. Free-space coupling puts less restrictions on lens array 140 due to the large acceptance angle of the photo-detectors as compared to a fiber. A subset 152 of the photo-detectors receive the optical channel signals 144 for the specified optical steering angle to generate a plurality of RF electrical feed signals 152 at the RF frequency that preserve the relative phase to produce an RF beam 154 at an RF steering angle $\theta_{RF}$. At a given steering angle, the unused photo-detectors are suitably turned off to prevent dark current emissions, if any.

The components of the OFN, namely collimating lens 120, optical beamformer 124 and lenses 140 may all be implemented using bulk optics. Alternately, optical fibers may be used to couple lenses 140 to the respective photodetectors 150.

Figure 4B:
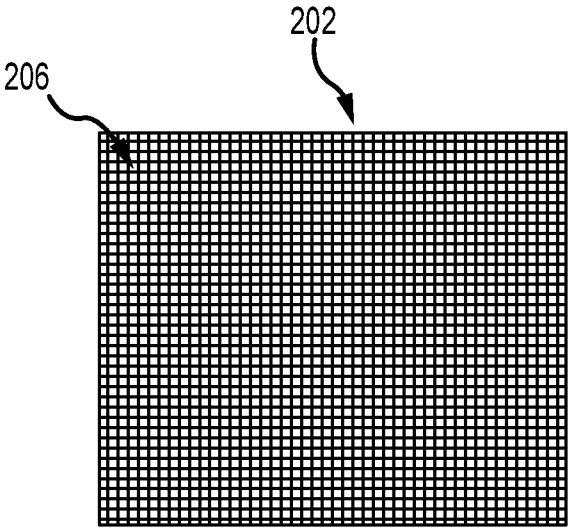
FIGS. 4*a* and 4*b* are diagrams of an embodiment of the free-space optical beamformer in which an optical beam steerer controls a phase delay across the wavefront to steer the free-space optical beam.
Figure 4A:
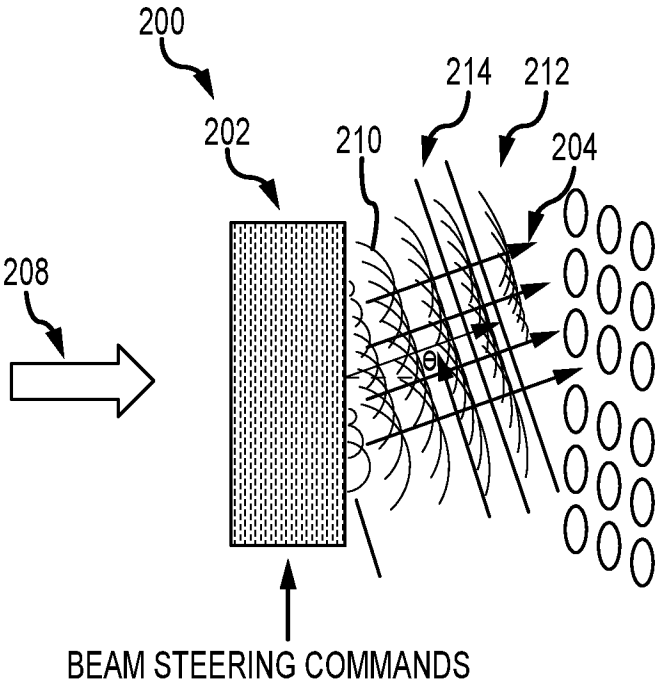

Referring now to FIGS. 4*a*-4*b*, an embodiment of an optical beamformer 200 includes an optical beam steerer 202 responsive to the beam steering commands to act on and induce different phase delays 204 to different regions 206 of the collimated first optical signal 208 to produce phase modulated optical signals 210 that combine to produce a free-space optical beam at the specified optical steering angle θopt. A wavefront 212 of the optical beam exhibits a phase delay, typically and as shown here a linear phase delay 214. As shown here, the optical beam steerer 202 is implemented as a transmission mode liquid crystal (LC) SLM in which different regions (also 206) are addressable to change the refractive index of the liquid crystal, which in turn changes the effective path length to induce the specified phase delay. Reflective mode LC or MEMs SLMs may be similarly implemented. The addressable SLM may define L×L regions or steering channels 206.

SLMs such as the LC or MEMS SLM provide the capability to address each of the L×L regions or channels 206 independently. In some cases, it may be desirable to change the individual phase delays applied to the channels independently thereby producing a non-linear phase delay across the two-dimensional wavefront 212 of the free-space optical beam. Depending on how the individual phase is changed, the non-linear phase delay may include spherical or aspherical terms in addition to the linear phase term. The linear phase term dictates the coarse steering of the composite optical signal. Spherical and aspherical terms allow for the fine-tuning of the steering angle through methods such as focusing power and wavefront correction. The SLM may be controlled to change the individual phase delays one at a time to make incremental changes to the phase delay across the two-dimensional wavefront.

Figures 5A, 5B, 5C:
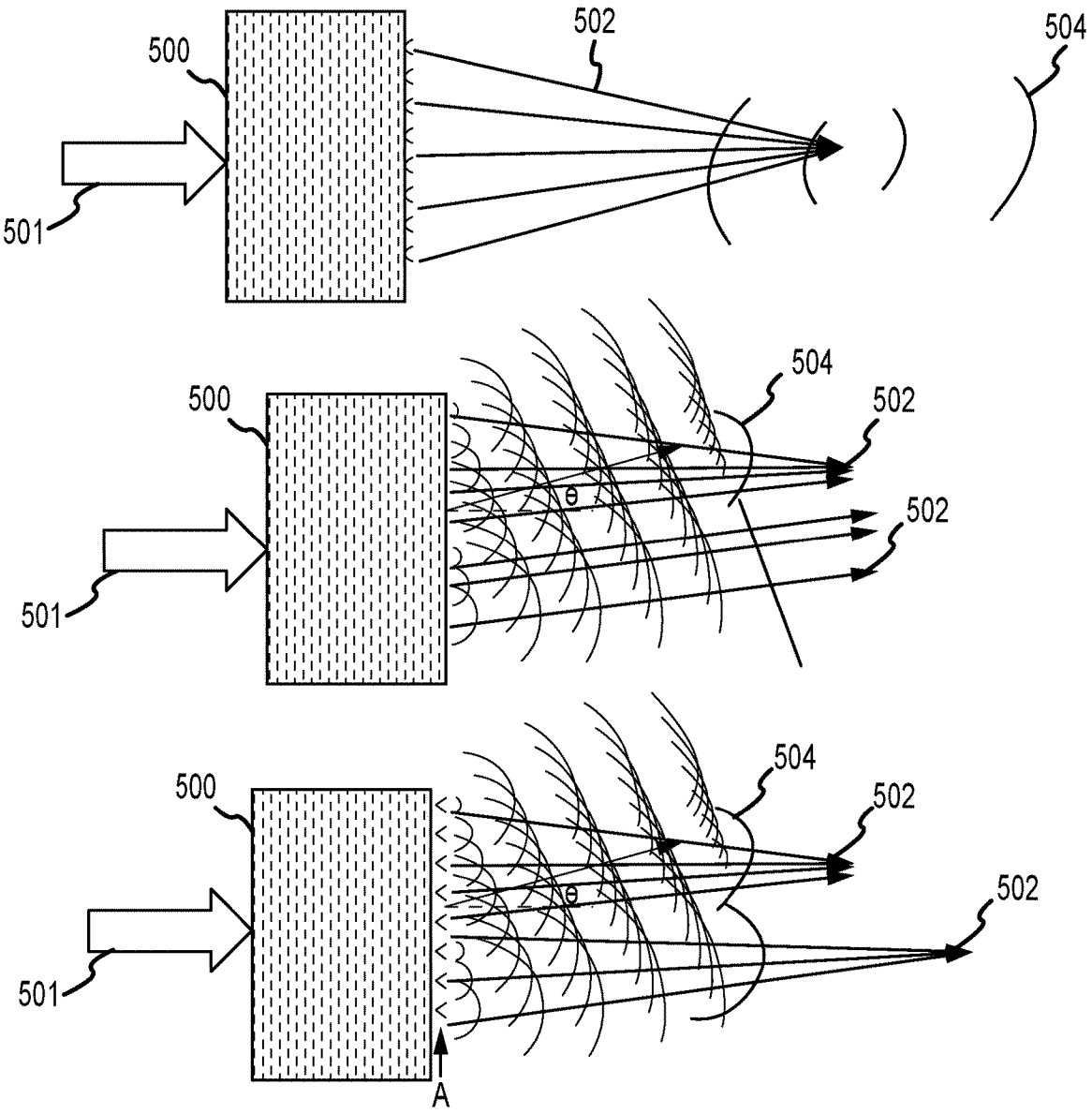
FIGS. 5*a* through 5*c* are diagrams in which the phase delay is controlled to induce spherical or aspheric terms into the phase delay across the wavefront of the optical beam.

As shown in FIG. 5*a*, SLM 500 acts on the collimated optical beam 501 to produce phase modulated optical signals 502 to induce a spherical term in the phase delay across the wavefront 504 such that the signals focus at a point and wavefront 504 exhibits have a curvature. If the linear term is zero, the curvature will be the radius of a circle. As shown in FIG. 5*b*, SLM 500 acts on the collimated optical beam 501 to produce phase modulated optical signals 502 to induce an aspherical term in the phase delay across the wavefront 504 that bends some of the signals 502. The two dimensional wavefront 504 has a curvature that changes across the wavefront. As shown in FIG. 5*c*, SLM 500 acts on the collimated optical beam 501 to produce phase modulated optical signals 502 to induce two different spherical terms such that the signals focus at two different points and the wavefront 504 has two different curvatures. The ability through the SLM to independently control the phase delay to the different channels allows for more flexible control over the two-dimensional wavefront acts on the collimated optical beam 501 to produce phase modulated optical signals 504 to finely steer and shape the optical beam, and thus the RF beam. Furthermore, the SLM can be controlled to make the changes to the phase delays on the different channels incrementally, or one at a time, to better control the steering angle.

Figure 6:
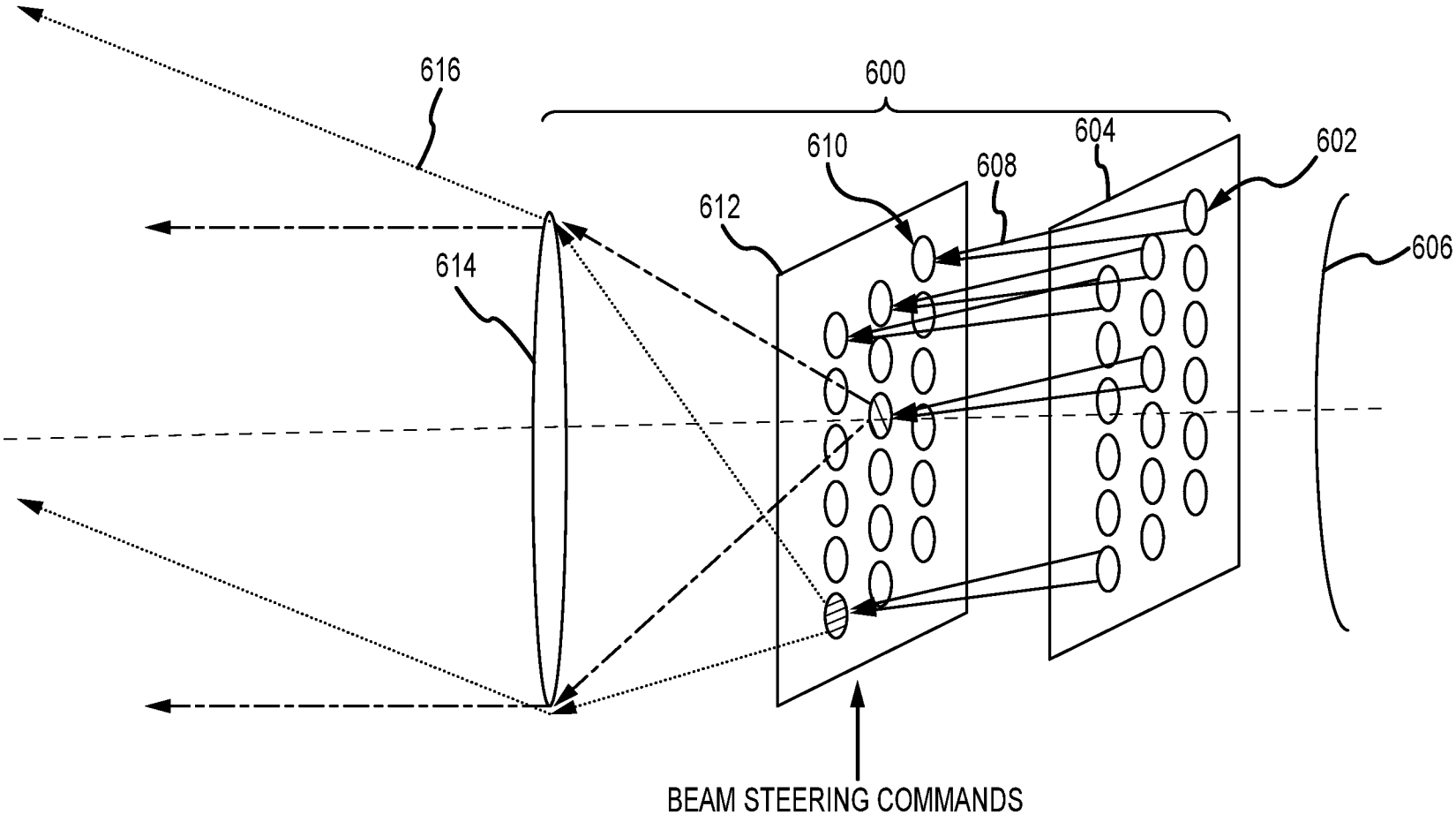
FIG. 6 is a diagram of an embodiment of the free-space optical beamformer in which lenses sample the wavefront of an optical signal to focus the light into multiple spots and a spatial light modulator selectively re-directs one more spots, whose position on the SLM corresponds to a specified steering angle, to an imaging lens to produce the free-space optical beam.

Referring now to FIG. 6, an embodiment of an optical beamformer 600 includes a plurality of lenses 602 (e.g. an L×L microlens array 604) configured to sample a wavefront 606 of the collimated first optical signal and focus the first optical signal into a plurality of spots 608 on pixels 610 of a spatial light modulator (SLM) 612 positioned at the focal distance of the lenses. The lenses/spot are suitably mapped in a 1-to-1 relationship with the SLM pixels 610. Alternately, multiple SLM pixels could be mapped to each spot to provide additional beam forming and shaping capability. The SLM pixels 610 are addressable and responsive to the beam steering commands to turn on one or more pixels whose position on the SLM corresponds to the specified optical steering angle to re-direct the first optical signals and to turn off the remaining pixels. An imaging lens 614 positioned at the focal distance from the SLM is configured to receive and collimate the re-directed first optical signals to produce a free-space optical beam 616 at the specified optical steering angle. The imaging lens produces a two-dimensional Fourier transform of the "on" pixels of the SLM. Hence, the position of the pixels on the SLM, and particularly their offset from the center of the imaging lens dictates the steering angle. An offset from the center of the imaging lens in X or Y object space corresponds to a steering angle in X or Y image space and vice-versa. The beam steering commands may turn on a single pixel at a time to form the free-space optical beam 616. In the simplest case, each available steering angle maps directly to one position or pixel on the SLM. As such, the SLM can be reconfigured very quickly to provide exceptionally fast and simple steering of the optical, and thus RF beam.

Figures 7A, 7B:
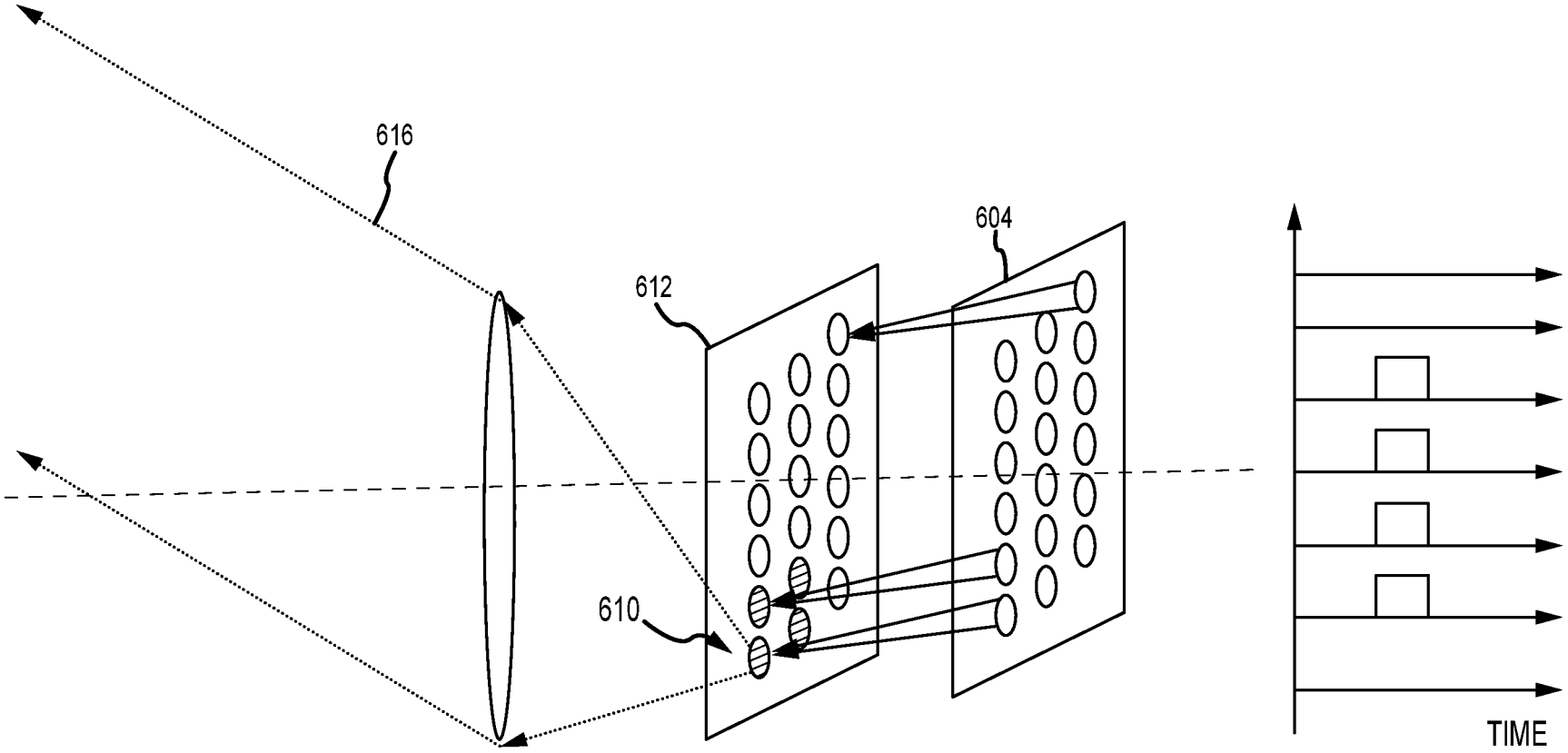
FIGS. 7*a* and 7*b* are diagrams in which multiple pixels are turn on simultaneously to form and shape the composite beam.

Referring now to FIGS. 7*a* and 7*b*, in response to the beam steering commands, the addressable SLM 612 simultaneously turns on a group of four pixels 610 to re-direct the respective sampled first optical signals to form, shape and steer the free-space optical beam 616.

Figure 8B:
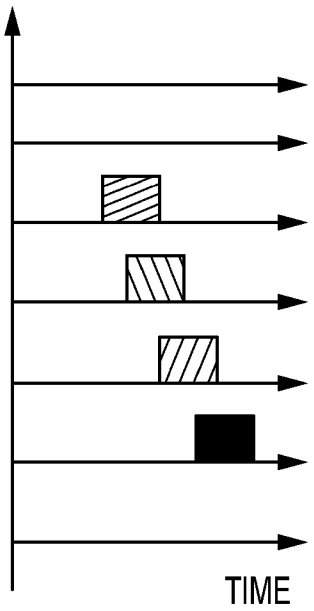
FIGS. 8*a* and 8*b* are diagrams in which multiple pixels are turn on in a time sequence to form and shape the composite beam.
Figure 8A:
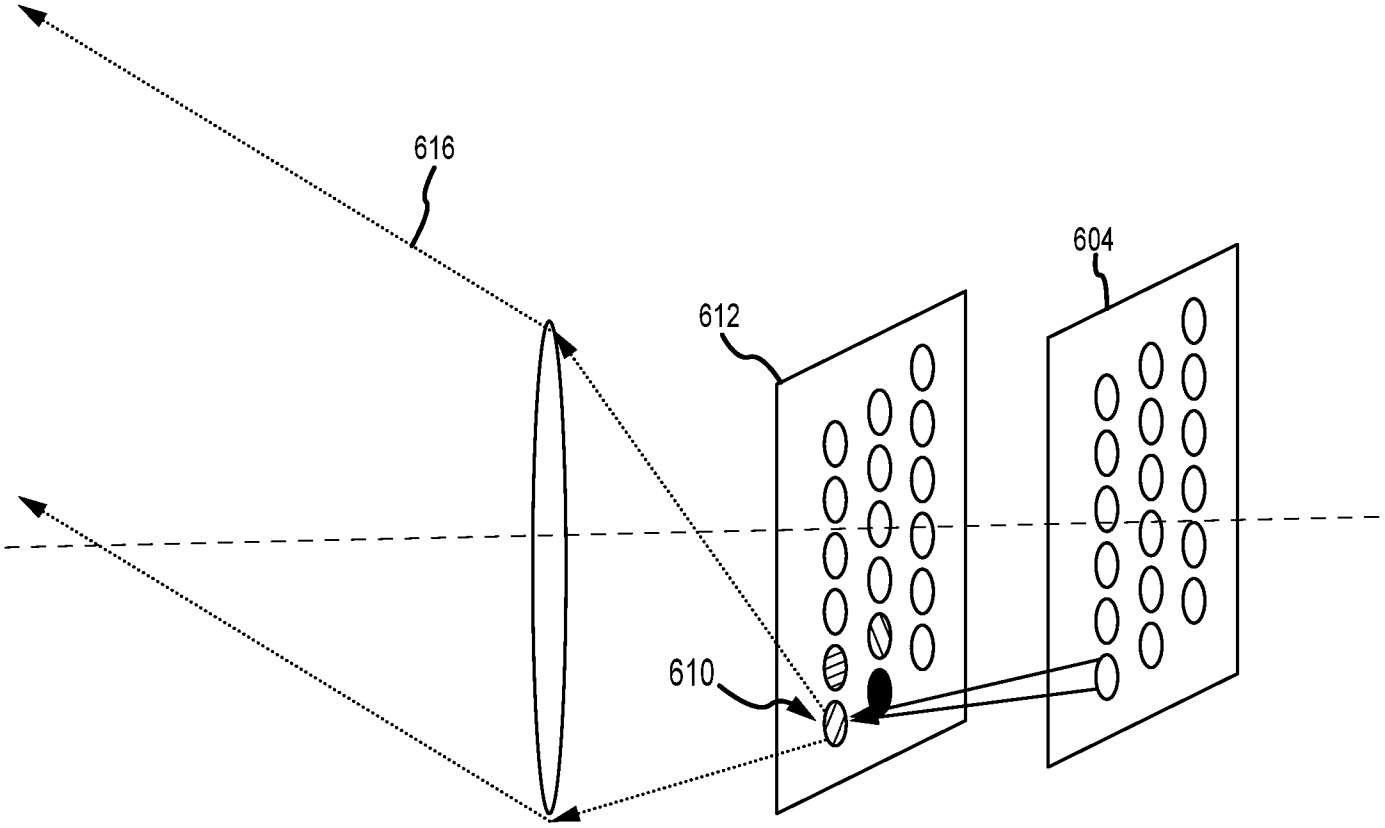

Referring now to FIGS. 8*a* and 8*b*, in response to the beam steering commands, the addressable SLM 612 turns on a group of four pixels 610 in a time-sequence to re-direct the respective sampled first optical signals to form, shape and steer the free-space optical beam 616.

Figure 9B:
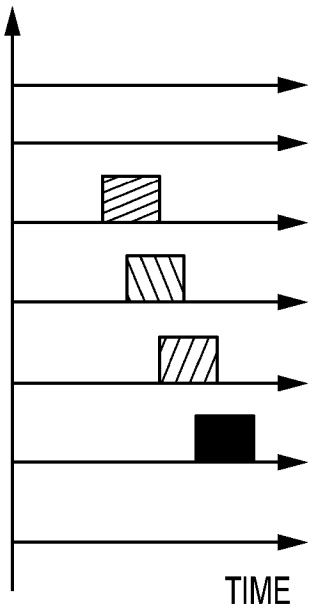
FIGS. 9*a* and 9*b* are diagrams in which multiple pixels are turn on within a single spot to form and shape the composite beam.
Figure 9A:
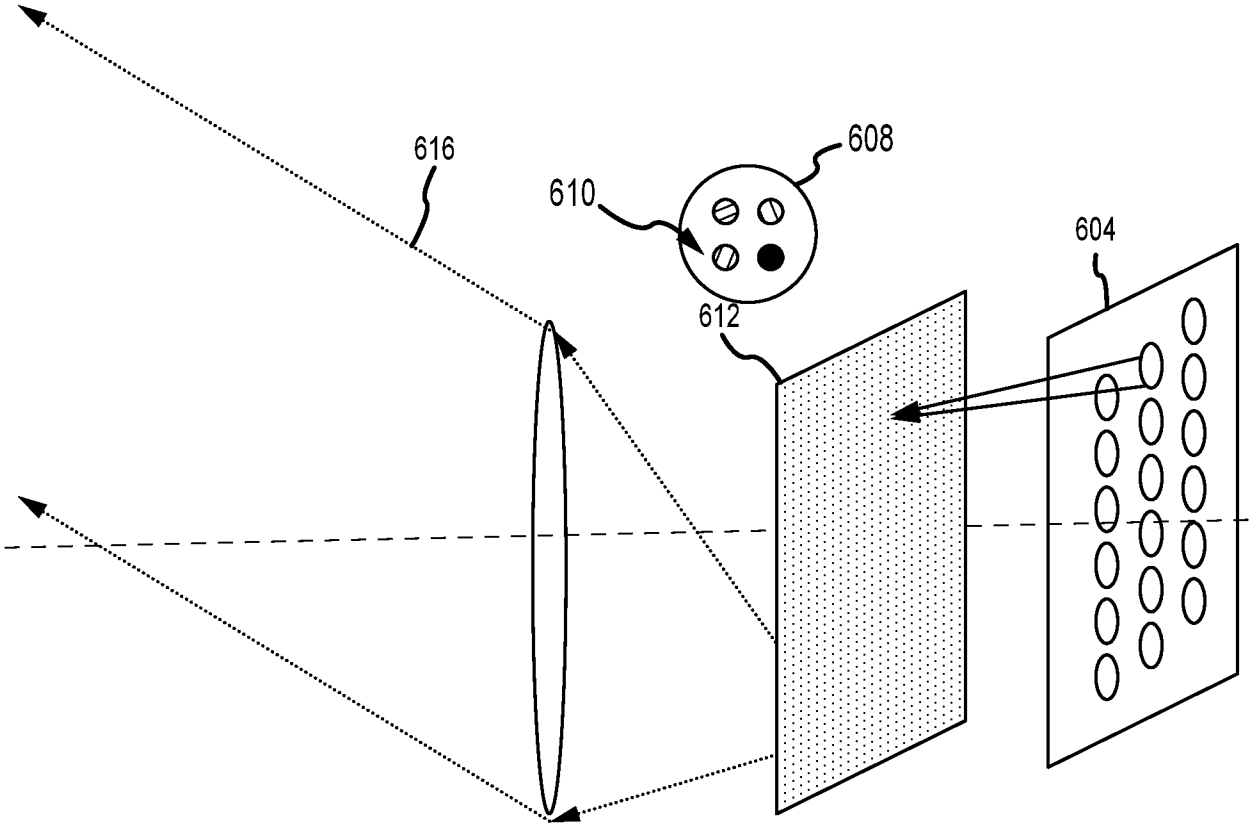

Referring now to FIGS. 9*a* and 9*b*, in response to the beam steering commands, the addressable SLM 612 turns on a group of four pixels 610 that are illuminated by a single spot 608 simultaneously or in a time-sequence to re-direct the respective sampled first optical signals to form, shape and steer the free-space optical beam 616.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. An optical feed network for an RF phased antenna array, comprising:

first and second optical signals at frequencies ω1 and ω2 having a frequency difference equal to an RF frequency;

a collimating lens that collimates the first optical signal;

an optical beamformer configured to receive the collimated first optical signal, said optical beamformer responsive to beam steering commands to process the collimated first optical signal and generate a free-space optical beam at a specified optical steering angle;

a first plurality of lenses configured to sample a wavefront of the optical beam over a range of optical steering angles, a subset of said first plurality of lenses sampling the wavefront at the specified optical steering angle to generate and focus a plurality of optical channel signals to preserve a relative phase between the optical channel signals and the wavefront;

a plurality of photo-detectors configured to detect the plurality of optical channel signals at frequency ω1 over the range of optical steering angles and the second optical signal at frequency ω2, a subset of said photo-detectors receiving the optical channel signals for the specified optical steering angle to generate a plurality of RF electrical feed signals at the RF frequency that preserve the relative phase to produce an RF beam at an RF steering angle; and a plurality of combiners between the first plurality of lenses and the plurality of photo-detectors, respectively, to combine the plurality of optical channel signals at frequency ω1 with the second optical signal at frequency ω2 to beat at the plurality of photo-detectors.

2. The optical feed network of claim 1, wherein the RF phased antenna array includes a plurality of antenna elements arranged in a first pattern configured to receive the RF electrical feed signals, wherein said plurality of lens are arranged in a second pattern corresponding to the first pattern.

3. The optical feed network of claim 1, wherein the collimating lens, optical beamformer and first plurality of lenses comprise bulk optics.

4. The optical feed network of claim 1, wherein the first plurality of lenses is implemented with a microlens array.

5. The optical feed network of claim 1, wherein said first plurality of lenses includes N lenses arranged in a two-dimensional pattern and the subset of lenses includes M lenses arranged in a two-dimensional pattern where M<N.

6. The optical feed network of claim 1, wherein the optical beam forms a spot on the subset of lenses, the position of the spot relative to the first plurality of lenses contains the phase information that determines the RF steering angle.

7. The optical feed network of claim 1, wherein the optical beamformer comprises:

an optical beam steerer responsive to the beam steering commands to act on and induce different phase delays to different regions of the collimated first optical signal that combine to produce the free-space optical beam at the specified optical steering angle.

8. The optical feed network of claim 7, wherein the optical beam steerer produces a phase delay with a linear term across the wavefront of the free-space optical beam.

9. The optical feed network of claim 8, wherein the optical beam steerer adds spherical or aspherical terms to the phase delay.

10. The optical feed network of claim 7, wherein the optical beam steerer comprises a liquid crystal or MEMs spatial light modulator.

11. The optical feed network of claim 1, wherein the optical beamformer comprises:

a second plurality of lenses configured to sample a wavefront of the collimated first optical signal and focus the first optical signal into a plurality of spots;

a spatial light modulator (SLM) comprising a plurality of pixels that receive the first optical signals in the plurality of spots, said pixels responsive to the beam steering commands to turn on one or more pixels whose position on the SLM corresponds to the specified optical steering angle to re-direct the first optical signals and to turn off the remaining pixels; and a lens configured to receive and collimate the re-directed first optical signals to produce the free-space optical beam at the specified optical steering angle.

12. The optical feed network of claim 11, wherein the second plurality of lenses is implemented with a microlens array.

13. The optical feed network of claim 11, wherein different optical steering angles are mapped to different pixel positions on the SLM.

14. The optical feed network of claim 11, wherein the lens produces a two-dimensional Fourier transform of the on pixels of the SLM.

15. The optical feed network of claim 11, wherein the steering commands turn on a single pixel at a time to form the free-space optical beam.

16. The optical feed network of claim 11, wherein the steering commands turn on multiple pixels simultaneously to form the free-space optical beam.

17. The optical feed network of claim 11, wherein the steering commands turn multiple pixels on in a time sequence to form the free-space optical beam.

18. An optical feed network for an RF phased antenna array, comprising:

first and second optical signals at frequencies ω1 and ω2 having a frequency difference equal to an RF frequency;

a collimating lens that collimates the first optical signal;

an optical beamformer configured to receive the collimated first optical signal, said optical beamformer comprising an optical beam steerer responsive to beam steering commands to act on and induce different phase delays to different regions of the collimated first optical signal that combine to produce a free-space optical beam at a specified optical steering angle;

a plurality of lenses configured to sample a wavefront of the optical beam over a range of optical steering angles, a subset of said plurality of lenses sampling the wavefront at the specified optical steering angle to generate and focus a plurality of optical channel signals to preserve a relative phase between the optical channel signals and the wavefront;

a plurality of photo-detectors configured to detect the plurality of optical channel signals at frequency ω1 over the range of optical steering angles and the second optical signal at frequency ω2, a subset of said photo-detectors receiving the optical channel signals for the specified optical steering angle to generate a plurality of RF electrical feed signals at the RF frequency that preserve the relative phase to produce an RF beam at an RF steering angle; and a plurality of combiners between the plurality of lenses and the plurality of photo-detectors, respectively, to combine the plurality of optical channel signals at frequency ω1 with the second optical signal at frequency ω2 to beat at the plurality of photo-detectors.

19. An optical feed network for an RF phased antenna array, comprising:

first and second optical signals at frequencies ω1 and ω2 having a frequency difference equal to an RF frequency;

a collimating lens that collimates the first optical signal;

an optical beamformer configured to receive the collimated first optical signal, said optical beamformer comprising a plurality of lenses configured to sample a wavefront of the collimated first optical signal and focus the first optical signal into a plurality of spots;

a spatial light modulator (SLM) comprising a plurality of pixels that receive the first optical signals in the plurality of spots, said pixels responsive to beam steering commands to turn on one or more pixels whose position on the SLM corresponds to a specified optical steering angle to re-direct the first optical signals and to turn off the remaining pixels; and a lens configured to receive and collimate the re-directed first optical signals to produce a free-space optical beam at the specified optical steering angle;

a plurality of lenses configured to sample a wavefront of the optical beam over a range of optical steering angles, a subset of said plurality of lenses sampling the wavefront at the specified optical steering angle to generate and focus a plurality of optical channel signals to preserve a relative phase between the optical channel signals and the wavefront;

a plurality of photo-detectors configured to detect the plurality of optical channel signals at frequency ω1 over the range of optical steering angles and the second optical signal at frequency ω2, a subset of said photo-detectors receiving the optical channel signals for the specified optical steering angle to generate a plurality of RF electrical feed signals at the RF frequency that preserve the relative phase to produce an RF beam at an RF steering angle; and a plurality of combiners between the first plurality of lenses and the plurality of photo-detectors, respectively, to combine the plurality of optical channel signals at frequency ω1 with the second optical signal at frequency ω2 to beat at the plurality of photo-detectors.

20. The optical feed network of claim 19, wherein different optical steering angles are mapped to different pixel positions on the SLM, and wherein the steering commands turn on a single pixel at a time to form the free-space optical beam.

* * * * *